US007303250B2

(12) United States Patent
Akase et al.

(10) Patent No.: US 7,303,250 B2
(45) Date of Patent: Dec. 4, 2007

(54) LIQUID EJECTION APPARATUS AND METHOD OF CONTROLLING THE SAME

(75) Inventors: Takashi Akase, Nagano (JP); Masahiro Kimura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 316 days.

(21) Appl. No.: 11/081,834

(22) Filed: Mar. 17, 2005

(65) Prior Publication Data

US 2005/0212851 A1 Sep. 29, 2005

(30) Foreign Application Priority Data

Mar. 17, 2004 (JP) ..... P2004-076344

(51) Int. Cl.
*B41J 2/165* (2006.01)

(52) U.S. Cl. ..... 347/23; 347/29; 347/30; 347/35

(58) Field of Classification Search ..... 347/22–35
See application file for complete search history.

(56) References Cited

U.S. PATENT DOCUMENTS 5,428,380 A * 6/1995 Ebisawa ..... 347/35

FOREIGN PATENT DOCUMENTS

| | | |
|---|---|---|
| JP | 8-156281 A | 6/1996 |
| JP | 9-183233 A | 7/1997 |
| JP | 10-181047 A | 7/1998 |
| JP | 10-258523 A | 9/1998 |

* cited by examiner

*Primary Examiner*—Shih-Wen Hsieh
(74) *Attorney, Agent, or Firm*—Sughrue Mion, PLLC

(57) ABSTRACT

A liquid ejection head is caused to eject liquid droplets at a region where no target medium is placed, such that such that a first prescribed number of liquid droplets are flushed from each of the nozzle orifices in the nozzle arrays of the first group, and a second prescribed number of liquid droplets are flushed from each of the nozzle orifices in the nozzle arrays of the second group. At least a part of the first prescribed number of liquid droplets and at least a part of the second prescribed number of liquid droplets are flushed by alternately performing a first unit operation for flushing a third prescribed number of liquid droplets which is smaller than the first prescribed number and a second unit operation for flushing a fourth prescribed number of liquid droplets which is smaller than the second prescribed number.

6 Claims, 7 Drawing Sheets

LIQUID EJECTION APPARATUS AND METHOD OF CONTROLLING THE SAME

BACKGROUND OF THE INVENTION

This invention relates to a liquid ejection apparatus such as an ink jet printer, and a method of controlling the same. This invention particularly relates to a liquid ejection apparatus capable of performing a flushing operation for forcibly ejecting liquid droplets from nozzle orifices, and a method for controlling such a liquid ejection apparatus.

A liquid ejection apparatus is equipped with a liquid ejection head, which can eject liquid in the form of droplets. As a representative example of this liquid ejection apparatus, there is an image recording apparatus such as an ink jet printer which ejects ink droplets onto recording paper, etc., as an ejection target to form dots thereon and thereby carry out recording. Also besides such an image recording apparatus, liquid ejection apparatuses are being applied to various manufacturing apparatuses in recent years. For example, with a display manufacturing apparatus for a liquid crystal display, plasma display, organic EL (electroluminescence) display, or FED (field emission display), etc., a liquid ejection apparatus is used to eject various liquid-form materials, such as color materials, electrode materials, etc., onto pixel forming regions, electrode forming regions, etc.

For example, in the above-mentioned ink jet printer (referred to hereinafter simply as "printer"), this printer is equipped with a the recording head, equipped in turn with pressure chambers, into which ink from an ink cartridge is supplied, a plurality of nozzle arrays formed by nozzle orifices, which are in communication with the pressure chambers, and pressure generating elements, which vary the pressure of the ink in the pressure chambers, and is arranged so that ink droplets are ejected from the nozzle orifices by the driving of the pressure generating elements.

During the recording operation of this printer, the free surfaces (meniscus) of ink at the nozzle orifices of the above-mentioned the recording head are exposed to air. Thus at nozzle orifices, with which the non-ejecting state is sustained during the recording operation, the solvent gradually evaporates and the ink becomes viscous with the elapse of the non-ejecting time, causing the occurrence of such ejection faults, as deviation of the direction of flight of ink droplets, failure of ejection of ink droplets, etc.

When the recording option is not being earned out, the nozzle opened surface of the above-described the recording head is sealed by a cap member to prevent the ink at the nozzle orifices from being viscous. However, in a case where the recording operation is not carried out for a long period of time, the solvent volatilizes and the ink becomes viscous gradually even in this sealed state, causing ejection faults, such as failure of ejection of ink droplets, especially the smallest ink droplets among the ink droplets ejectable by the recording head, to occur at the start of a subsequent recording operation.

In order to prevent such ejection faults in advance, flushing operation for forcibly ejecting ink droplets of a number (prescribed flushing number) necessary for ejecting viscous ink, solidified ink or other unnecessary ink and thereby preventing ejection faults, is carried out independently of the recording operation (eject operation) in this type of printer (see for example, Japanese Patent Publication No. 10-181047A). In this flushing operation, the ejection of a prescribed flushing number of ink droplets from all nozzles is carried out at the position opposing to an ink receiving member. Since the unnecessary ink is ejected by this flushing operation, ejection faults can be prevented in advance.

FIG. 7 is a time chart for describing an example of a flushing operation in a such a printer. With this example, the prescribed flushing number is set to 1000 shots, and first the flushing operation is carried out on odd-number nozzle arrays among the plurality of nozzle arrays until the prescribed flushing number is completed, and thereafter, the flushing operation is carried on even-number nozzle arrays until the prescribed flushing number is completed. Also, prior to the flushing operation of the odd-number nozzle arrays and prior to the flushing operation of the even-number nozzle arrays, a pre-flushing meniscus vibration is carried out. This pre-flushing meniscus vibration is carried out to agitate the ink to some degree to make the unnecessary ink be ejected more readily in the flushing operation.

In recent years, there has been an increasing demand for improvement of the recording operation speed of printers, and the shortening of the time for the flushing operation as much as possible is being desired. However, if the flushing operation is simply shortened, flushing of an amount adequate for preventing ejection faults cannot be carried out.

Also, especially in the case where, after the activation of a printer following a state in which the printer has not been used for a long period of time and a flushing operation is carried out prior to a recording operation, there is a high possibility that viscous ink or solidified ink exists at the vicinity of the nozzle orifices, and since in this case, a large flushing number (number of ejected ink droplets during the flushing operation) is required for ejection of the viscous ink, solidified ink, or other unnecessary ink, much time and a large amount of ink are consumed correspondingly.

SUMMARY OF THE INVENTION

It is therefore an object of the invention to improve the ejection efficiency of viscous liquid in a flushing operation.

In order to achieve the above object, according to the invention, there is provided an liquid ejection apparatus, comprising:

- a liquid ejection head, comprising:
  - pressure chambers, each of which is adapted to store-liquid therein;
  - nozzle orifices, each of which is communicated with one of the pressure chambers, the nozzle orifices being arranged so as to form a first group of nozzle arrays and a second group of nozzle arrays; and
  - pressure generating elements, each of which is operable to generate pressure fluctuations in the liquid stored in one of the pressure chambers to eject a liquid droplet from one of the nozzle orifices associated with the one of the pressure chamber;
- a first region, in which a target medium to which the liquid droplet is landed is placed;
- a second region, in which no target medium is placed; and
- a controller, operable to cause the liquid ejection head to flush liquid droplets at the second region such that a first prescribed number of liquid droplets are flushed from each of the nozzle orifices in the nozzle arrays of the first group, and a second prescribed number of liquid droplets are flushed from each of the nozzle orifices in the nozzle arrays of the second group,
- wherein at least a part of the first prescribed number of liquid droplets and at least a part of the second prescribed number of liquid droplets are flushed by alternately execution a first unit operation for flushing a third prescribed number of liquid droplets which is smaller than the first prescribed number and a second unit operation for flushing a fourth prescribed number of liquid droplets which is smaller than the second prescribed number.

Here, the first prescribed number and the second prescribed number may be identical with each other or different from each other. Further, the third prescribed number and the fourth prescribed number may be identical with each other or different from each other.

With the above configuration, the liquid in the nozzle orifice in one of the first and second groups can be agitated by residual vibrations while the nozzle orifice in the other one of the first and second groups is subjected to the flushing operation. Accordingly, unnecessary liquid such as viscous liquid can be ejected more efficiently. Since the unnecessary liquid ejection can thus be obtained adequately with a lower flushing number, the time required for the flushing operation can be shortened to speed up the overall operations of the apparatus and lower the consumption amount of liquid during the flushing operation.

Further, contributions can be made to improvement of the unnecessary liquid ejection while making one resting period (duration of the non-flushing state) as short as possible and yet preventing liquid from being viscous.

Preferably, a meniscus of the liquid in each of the nozzle orifices in the first group of the nozzle arrays is vibrated such an extent that a liquid droplet is not ejected therefrom while the second unit operation is performed. Incidentally, a meniscus of the liquid in each of the nozzle orifices in the second group of the nozzle arrays is vibrated such an extent that a liquid droplet is not ejected therefrom while the first unit operation is performed.

With this configuration, the agitation of the liquid can be further promoted.

Preferably, one of the nozzle arrays in the first group and one of the nozzle arrays in the second group are arranged adjacent to each other.

With this configuration, simultaneous flushing of adjacent nozzle arrays is avoided. Accordingly, efficient ejection of unnecessary liquid can be carried out while restraining the generation of an updraft at regions between adjacent nozzle arrays and thereby preventing the problem of a part of the ejected liquid droplets becoming a mist and riding on the updraft and thereby becoming attached to the nozzle formation face of the liquid ejection head.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Embodiments of the invention will be described below in detail with reference to the accompanying drawings. An ink jet printer (abbreviated hereinafter as "printer") will be described as an example of the liquid ejection apparatus of the invention.

Figure 1:
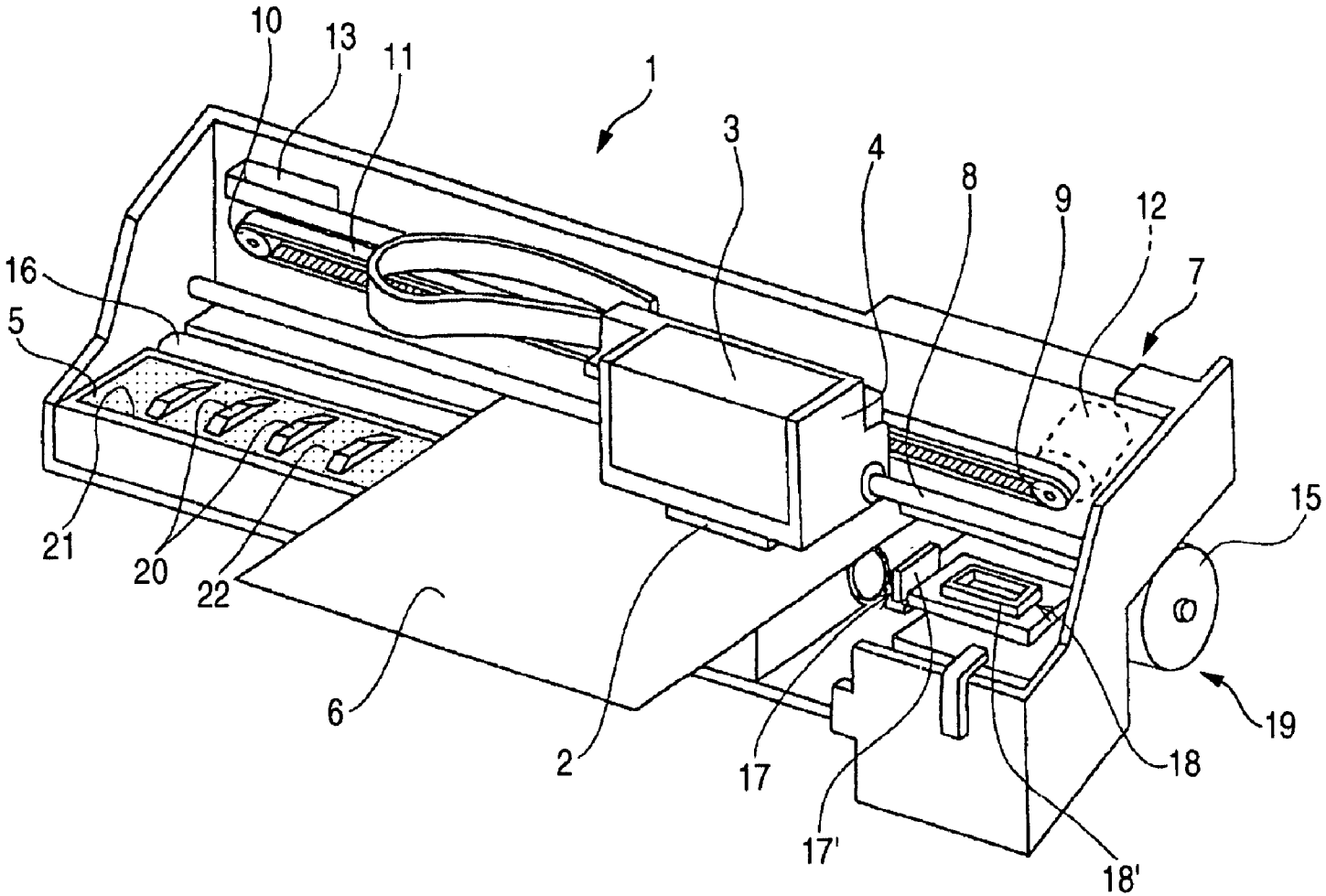
FIG. 1 is a perspective view of an ink jet printer according to one embodiment of the invention.

A printer 1, illustrated in FIG. 1 is generally arranged by being equipped with a carriage 4 which carries a recording head 2 adapted to eject ink in the form of ink droplets and mounted thereto and an, ink cartridge 3 mounted detachably thereto; a platen 5 disposed below the recording head 2; a carriage driving mechanism 7 for moving the recording head 2 (carriage 4) in the width direction of recording paper 6; and a paper feeding mechanism 19 for conveying the recording paper 6 in a paper feeding direction, which is a direction orthogonal to the head moving direction. Here, the paper width direction is referred as a primary scanning direction, and the paper feeding direction is referred a secondary scanning direction.

The carriage 4 is mounted in a state in which it is supported by a guide rod 8 extending in the primary scanning direction and is connected to a timing belt 11, which is spanned between a drive pulley 9 and a follower pulley 10. The drive pulley 9 is joined to a rotating shaft of a pulse motor 12, and by the actuation of this pulse motor 12, the carriage 4, that is, the recording head 2, is moved in the primary scanning direction along guide rod 8. The carriage driving mechanism 7 is thus composed of the guide rod 8, the drive pulley 9, the follower pulley 10, the timing belt 11, and the pulse motor 12.

Figure 3:
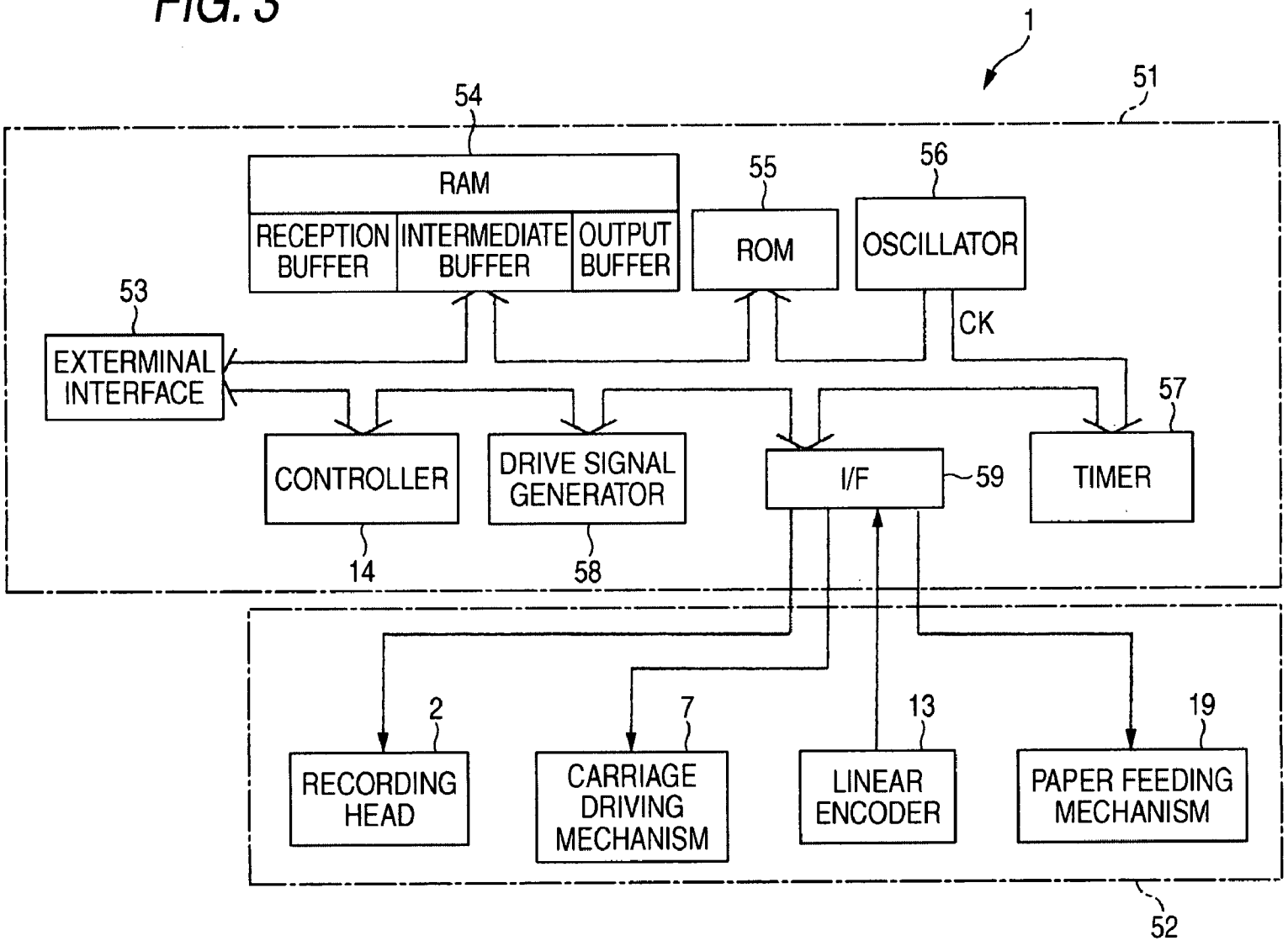
FIG. 3 is a block diagram showing an electrical configuration of the ink jet printer.

The position of the recording head 2 (carriage 4) in the primary scanning direction is detected by a linear encoder 13 and the detection signal is transmitted as position information to a controller 14 (see FIG. 3). The controller 14 can thereby control a recording operation by the recording head 2, a flushing operation for forcibly ejecting ink droplets independently of the recording operation, etc., while recognizing the scanning position of the recording head 2 based on the position information from the linear encoder 13.

The paper feeding mechanism 19 is composed of a paper feeding motor 15, which serves as a drive source, a paper feeding roller 16, which is driven to rotate by paper feeding motor 15. This paper feeding mechanism 19 is arranged to convey the recording paper 6, set on the platen 5, in the paper feeding direction by rotation of the paper feeding roller 16 by the driving of paper feeding motor 15 under the control of the controller 14 during the secondary scanning operation.

A home position, which is a reference position for the scanning of the recording head 2, is set in a region, located at the outer side (right side in FIG. 1) of the platen 5 but within the movement range of the recording head 2. At this home position are disposed a wiper mechanism 17, for cleaning the surface of a nozzle plate 33 (see FIG. 2) of the recording head 2, and a capping mechanism 18, which can seal this nozzle plate 33.

The wiper mechanism 17 is equipped with a wiper blade 17', prepared from an elastomer or other elastic member, and is arranged to rub the wiper blade 17' against the nozzle plate 33 when the recording head 2 passes above to thereby wipe off ink and other soiling matter that have become attached to the nozzle plate 33.

Figure 2:
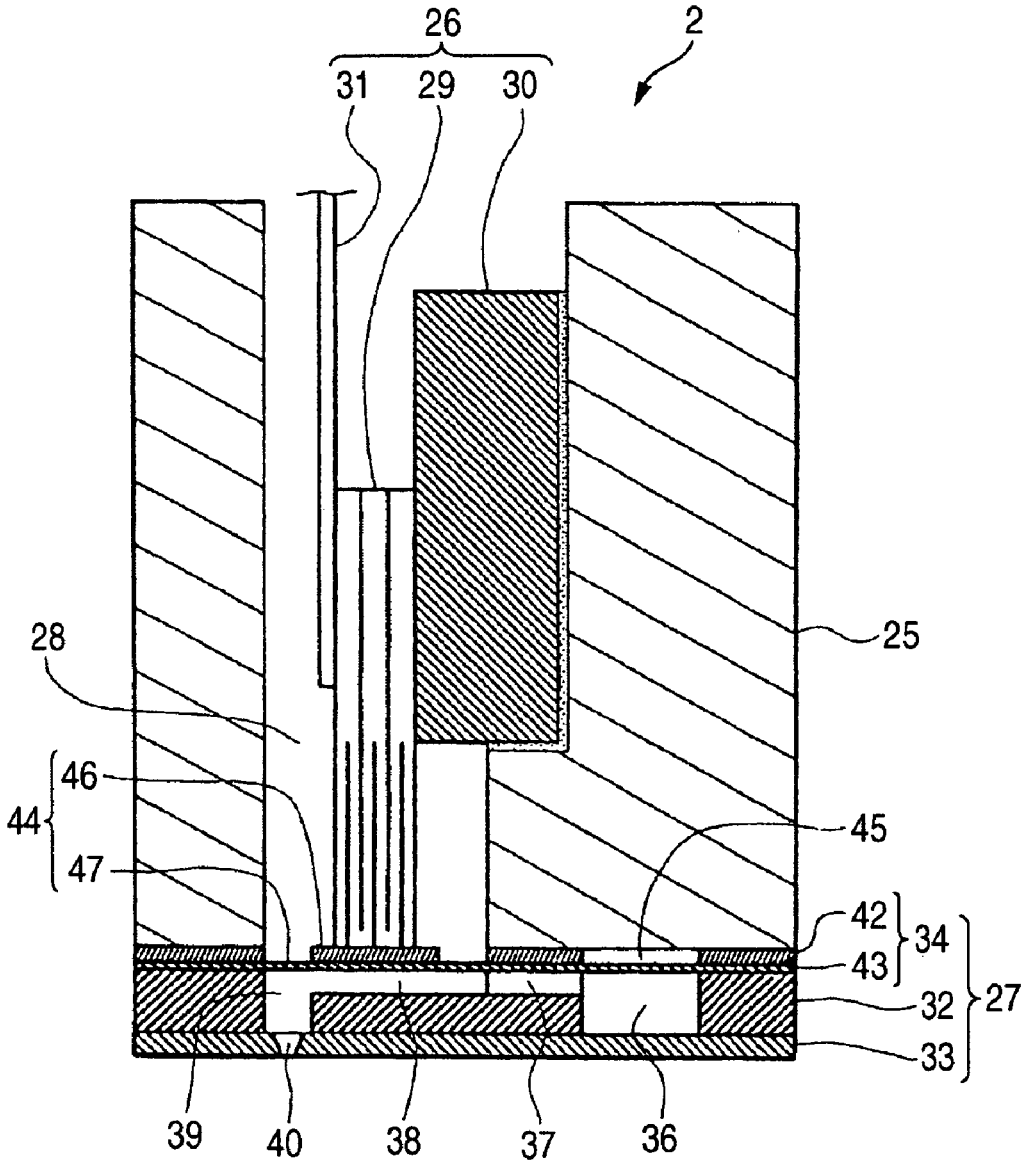
FIG. 2 is a vertical section view of a the recording head in the ink jet printer.

The capping mechanism 18 seals the nozzle plate 33 of the recording head 2 in the standby state by a tray-shaped cap member 18', which is opened at the upper side, and thereby prevents the evaporation of the ink solvent from nozzle orifices 40 (see FIG. 2).

The platen 5 is a member for regulating and guiding the recording paper 6. A plurality of contact protrusions 20 (also called "diamond ribs") are protruded upward on the upper surface of the platen 5. These contact protrusions 20 contact the back face of the recording paper 6 to support the same. The surroundings of the contact protrusions 20 are formed as a groove part 21, which is formed one step lower than the peripheral parts of platen 5, and a sponge or other liquid absorbing member 22 is disposed in this groove part 21. This liquid absorbing member 22 is a member that absorbs ink droplets, which have been ejected outside the range of the recording paper 6, to prevent the soiling of the interior of the apparatus. The lower part of this liquid absorbing member 22 is in communication with an unillustrated waste liquid tank, and ink droplets that are ejected into the liquid absorbing member 22 are made to permeate towards the waste liquid tank and be stored in this waste liquid tank.

The cap member 18' of the above-described capping mechanism 18 and the liquid absorbing member 22 of the platen 6 are also used during the flushing operation. That is, in the execution of the flushing operation, the cap member 18' and the liquid absorbing member 22 are used as receivers of ink droplets ejected from the recording head 2.

The above-mentioned the recording head 2 will be described with reference to FIG. 2. The recording head 2 comprises: a case 25; a vibrator unit 26 housed inside the case 25; a flow path unit 27 joined to the bottom face of the case 25. The above-mentioned case 25 is prepared, for example, from an epoxy-based resin and in the interior thereof is formed a housing space 28 for housing the vibrator unit 26. The vibrator unit 26 comprises: a piezoelectric vibrator 29 which serves as a pressure generating element a fixed plate 30 to which piezoelectric vibrator 29 is joined; and a flexible cable 31 for supplying drive signals, etc., to piezoelectric vibrator 29. The piezoelectric vibrator 29 is a laminated type piezoelectric vibrator, prepared by cutting a piezoelectric plate, which is formed by alternately laminating piezoelectric material layers and electrode layers, in a pectinated manner, and is a longitudinal vibration mode piezoelectric vibrator that can extend and contract in directions orthogonal to the direction of lamination.

The flow path unit 27 is arranged by joining the nozzle plate 33 to one surface of a flow path formation substrate 32 and joining an elastic plate 34 to the other surface of the flow path formation substrate 32. A reservoir 36, an ink supplying port 37, a pressure chamber 38, a nozzle communication port 39, and a nozzle orifice 40 are disposed in this flow path unit 27. An ink flow path, extending form the ink supplying port 37 to the nozzle orifice 40 via the ink pressure chamber 38, and the nozzle communication port 39, is thus formed in correspondence to each nozzle orifice 40.

The above-mentioned nozzle plate 33 is a thin, metal plate in which a plurality of nozzle orifices 40 are opened at a pitch corresponding to a dot forming density (for example, 180 dpi), so as to form nozzle arrays. With the present embodiment, this nozzle plate 33 is composed of a stainless-steel plate member. One nozzle array is composed, for example, of 180 nozzle orifices 40. The recording head 2 of this embodiment is arranged to enable the ejection of the total of six types of ink of cyan (C), red (R), magenta (M), violet (V), yellow (Y), and black (K), and a total of six nozzle arrays, from a first nozzle array to a sixth nozzle array, are formed in nozzle plate 30 in correspondence to the respective colors.

The above-mentioned elastic plate 34 has a double structure in which an elastic film 43 is laminated on the surface of a supporting plate 42. With this embodiment a stainless steel plate, which is one type of metal plate, is arranged as the supporting plate 42, and the elastic plate 34 is prepared using a composite plate member with which a resin, film is laminated as the elastic film 43 onto the surface of the supporting plate 42. This elastic plate 34 is provided with a diaphragm part 44, which changes the volume of the pressure chamber 38. Also, this elastic plate 34 is provided with a compliance part 45, which seals a part of the reservoir 36.

The above-mentioned diaphragm part 44 is prepared by removing parts of the supporting plate 42 by etching, etc. That is, this diaphragm part 44 comprises an island part 46, onto which the tip end face of the piezoelectric vibrator 29 is joined, and a thin elastic part 47 that surrounds this island part 46. The above-mentioned compliance part 45 is prepared by removing a region of the supporting plate 42 that opposes the opened face of the reservoir 36 by etching, etc., in the same manner as the diaphragm part 44 and serves as a damper that absorbs pressure fluctuations of the liquid stored in the reservoir 36.

Since the tip end face of the piezoelectric vibrator 29 is joined to the above-mentioned island part 46, the volume of the pressure chamber can be varied by extending and contracting the free end part of the piezoelectric vibrator 29. In accompaniment with this volume variation, a pressure variation occurs in the ink inside the pressure chamber 38. The recording head 2 is arranged to eject ink droplets from the nozzle orifices 40 using this pressure variation.

As shown in FIG. 3, the printer 1 comprises a printer controller 51 and a print engine 52. The printer controller 51 comprises: an interface (external I/F) 53, for receiving printing data, etc., from an unillustrated host computer or other external apparatus; a RAM 54, for storing various data, etc.; a ROM 55, for storing routines for various data processing, etc. the controller 14, which is constituted by a CPU, etc., and performs electrical control of various parts; an oscillator 56, which generates a clock signal; a timer 57; a drive signal generator 58, which generates the drive signals to be supplied to the recording head 2; and an interface (internal I/F) 59, for transmitting the ejection data, obtained by converting the print data into a dot pattern data, the drive signals supplied from drive signal generator 58, etc., to the print engine 52 side. These components are connected to each other by an internal bus.

The external I/F 53 receives printing data, which, for example, comprises at least one of character codes, graphic functions and image data, supplied from a host computer or other external apparatus. Also, the external I/F 53 outputs a busy signal (BUSY), an acknowledge signal (ACK), and other status signals that indicate the state of printer 1. The RAM 54 is used as a receiving buffer, an intermediate buffer, an output buffer, or a work area (not shown), etc. The printing data, received by the external I/F 53 from the external apparatus, are stored temporarily in the receiving buffer. Intermediate code data, converted by the controller 14, are stored in the intermediate buffer. The ejection data, transmitted to the recording head 2, are converted in the output buffer. The ROM 55 stores the various control routines executed by the controller 14 as well as font data, graphic functions, various procedures, etc.

The controller 14 converts the printing data, sent from the external apparatus, into ejection data, corresponding to a dot pattern that indicates the forming of any of large dots, medium dots, or small dots or indicates that no dots are to be formed, and sends the ejection data to the recording head 2. Here, the controller 14 reads and converts the printing data in the receiving buffer into intermediate code data and stores the intermediate code data in the intermediate buffer. The controller 14 then analyzes the intermediate code data read from the intermediate buffer and references the font data, graphic functions, etc., in ROM 55 to convert the intermediate code data into ejection data. Then when ejection data for one line, corresponding to a single primary scanning, are obtained in the output buffer, these ejection data for one line are transmitted serially to the recording head 2 through internal I/F 59. When the ejection data for one line are sent from the output buffer, the contents of the intermediate buffer are erased and the conversion of the next set of intermediate code data is performed.

Also, the above-mentioned controller 14 is arranged to control the flushing operation by moving the recording head 2 to a flushing position of the ink receiving member (cap member 18') prior to the starting of the recording operation after the power of printer 1 is turned on and at fixed intervals during the recording operation. The details of this flushing operation will be described later.

The operation of the above-mentioned drive signal generator 58 is controlled by controller 14 so as to generate various drive signals. In this embodiment, the drive signal generator 58 is arranged to be able to generate recording drive signals, which are used in the normal recording operation, and flushing drive signals, which are used in the flushing operation, and supplies these drive signals to the recording head 2 side via internal I/F 56. At the recording head 2, ink droplets of amounts that are in accordance to the drive pulses are ejected or vibrating of the meniscus exposed at each nozzle orifice 40 is carried out during the recording operation or the flushing operation.

Figure 4:
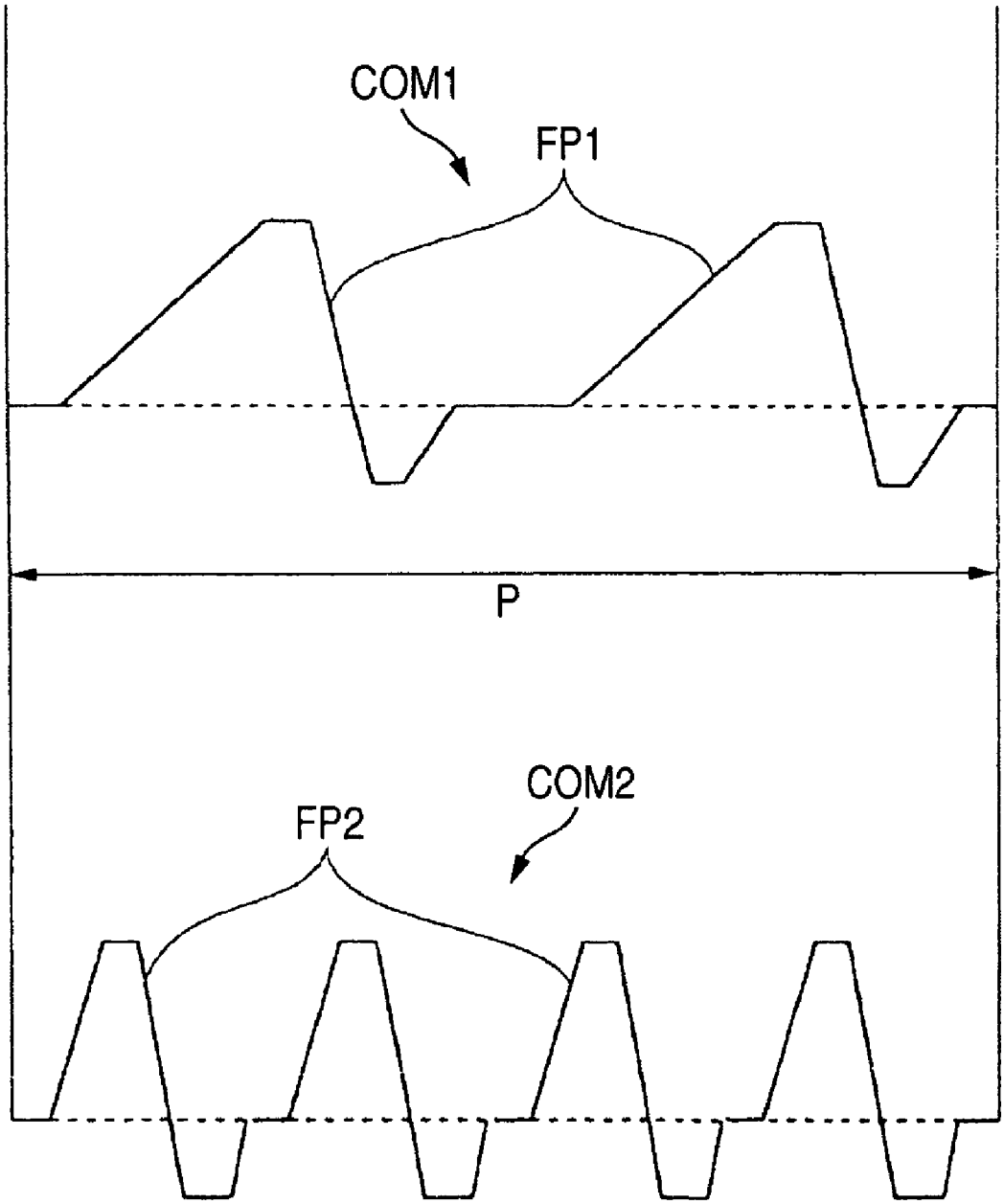
FIG. 4 is a waveform diagram showing signals for driving the recording head to perform a flushing operation.

FIG. 4 shows examples of the flushing drive signals generated by drive signal generator 58 during the flushing operation. In this embodiment, the drive signal generator 58 is arranged to be able to generate the total of two types of flushing drive signals of first drive signal COM1 and second drive signal COM2. The first drive signal COM1 is arranged to generate a first flushing pulses FP1, which causes ink to be filled in pressure chamber 38 while restraining the drawing in of the meniscus towards the pressure chamber 38 side and then causes ink-filled pressure chamber 38 to contract rapidly to eject an ink drop, twice within a period P. The other second drive signal COM2 is arranged to generate a second flushing pulse FP2, which causes pressure chamber 38 to expand rapidly to fill the interior of pressure chamber 38 with ink and then causes ink-filled pressure chamber 38 to contract rapidly to eject an ink drop, four times within period P. Second drive signal COM2 of this embodiment is thus set to a drive frequency that is twice that of first drive signal COM1.

The above-described first drive signal COM1 is for destroying a viscous meniscus and efficiently ejecting viscous ink solidified ink, or other unnecessary ink near the nozzle orifices and is a flushing drive signal that is mainly used during the first half of the flushing operation. Also, the above-described second drive signal COM2 is set so that the amount of ink drop ejected per unit time will be large and is a flush drive signal that is mainly used in the latter half of the flushing operation. Thus in the flushing operation, a two-step drive control is carried out wherein, after destroying the meniscus and ejecting the unnecessary ink near the nozzle orifices in the first half, the flushing amount per unit time is increased to eject the unnecessary ink at the pressure chamber 38 side as well in the latter half.

The flushing operation of printer 1 with the above-described arrangement shall now be described. With the present embodiment, the first nozzle array to the sixth nozzle array are classified into odd-number nozzle arrays and even-number nozzle arrays, and until a prescribed flushing number of ejections are completed, the unit flushing operations are performed alternately for the odd-number nozzle arrays and even-number nozzle arrays, and control is carried out so that when either of the odd-number nozzle arrays or the even-number nozzle arrays are in the flushing, state, the other arrays are in the non-flushing state.

Here, the above-mentioned prescribed flushing number refers to the number of times of ejection, which is defined for each nozzle array so that the minimum dot can be formed without any problem (without any ejection faults) in the first ejection after completion of the flushing operation. Also, the above-mentioned unit flushing number refers to the number of times of flushing that is an operation unit in the flushing operation and is a flushing number that is set to an ejection number that is less than the prescribed flushing number. Though this prescribed flushing number and unit flushing number differ according to the printer and circumstances, etc., for the sake of convenience, a description for this embodiment is provided for the case where the prescribed flushing number is set to 1000 shots and the unit flushing number is set to 8 shots for all nozzle arrays.

When the timing for execution of the flushing operation arrives, as in immediately after the activation of the printer 1, the controller 14 controls carriage moving mechanism 7 and moves the recording head 2 to the flushing position, that is, to a position above cap member 18'. The controller 14 then divides the first nozzle array to sixth nozzle array into the two groups of odd-number nozzle arrays (first, third, and fifth nozzle arrays) and even-number nozzle arrays (second, fourth, and sixth nozzle arrays) and performs the flushing operation at mutually shifted timings on each group.

In regard to this division of nozzle arrays, if the flushing operation, that is, continuous ejection of ink droplets of large amounts, is carried out simultaneously on an odd-number nozzle array and an even-number nozzle array that are adjacent each other since nozzle orifices 40 of these nozzle arrays are close to each other, an updraft is generated at regions between the adjacent nozzle arrays, A part of the ejected ink then becomes a mist that rides on this updraft and becomes attached to the peripheries of nozzle orifices 40. The nozzle arrays are thus divided as described above to avoid such a problem.

Figure 5:
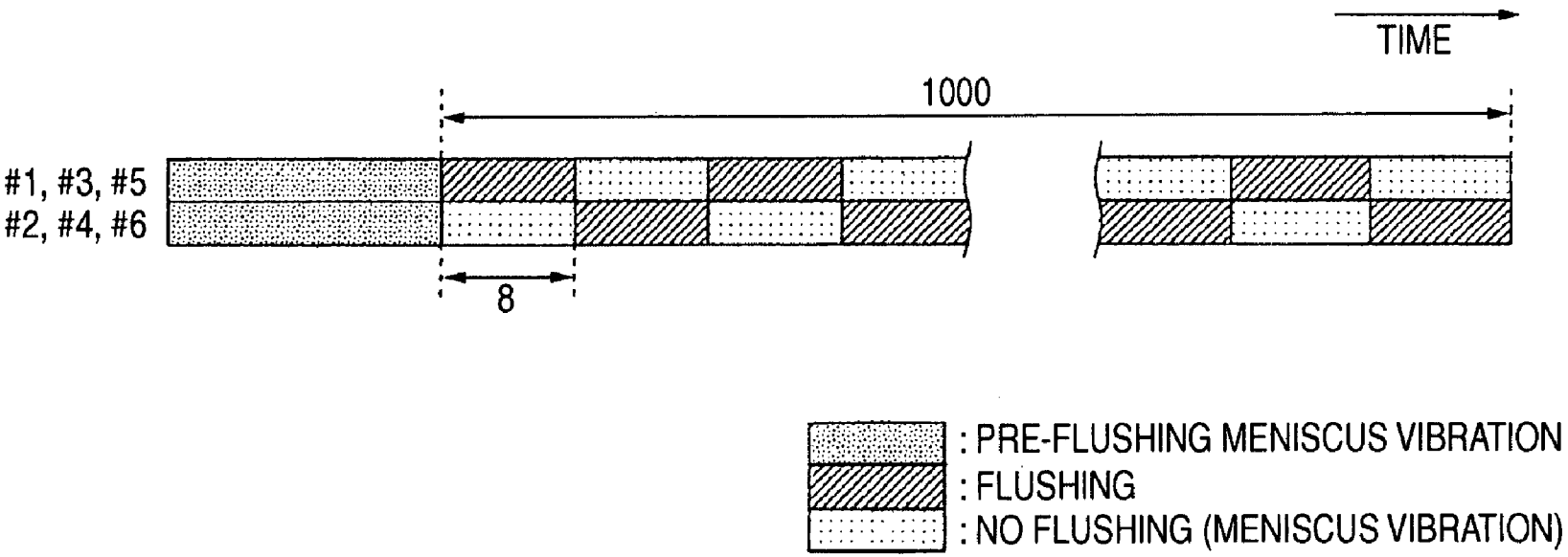
FIG. 5 is a time chart for explaining the flushing operation.

FIG. 5 is a diagram showing an example of a time chart of the flushing operation of the present embodiment. In this Figure, time elapses from the left side to the right side. As shown, the controller 14 first executes a pre-flushing meniscus vibration on all nozzle arrays (first nozzle array to sixth nozzle array) immediately prior to the flushing operation. This pre-flushing meniscus vibration is performed to agitate the ink to some degree prior to the flushing operation to make the unnecessary ink be ejected readily in the subsequent flushing operation.

When the pre-flushing meniscus vibration has been performed, the controller 14 performs the flushing operation by alternately executing the unit flushing operation including the unit number of ejections at the odd-number nozzle arrays and even-number nozzle arrays until the prescribed number of ejections are completed for both groups. That is, in the present embodiment, since the prescribed flushing number is set to 1000 shots and the unit flushing number is set to 8 shots for both groups, a total of 250 times of alternations are carried out. Thus when either the odd-number nozzle arrays or even-number nozzle arrays are in the flushing state, the other arrays are in the non-flushing state. In other words, for each group of arrays, the flushing operations are intermittently performed while interposing resting periods (non-flushing state) between subsequent unit flushing operations. With this configuration, the ink can be agitated by the residual vibration during the resting period, and in particular, the unnecessary ink that remains at the peripheral parts of nozzle orifices 40, which cannot be ejected readily by just the normal flushing operation, can also be agitated.

Though with the example of FIG. 5, the flushing operation of the odd-number nozzle a is started before that of the even-number nozzle arrays, the flushing operation of the even-number nozzle arrays may obviously be started before that of the odd-number nozzle arrays instead.

Also, controller 14 promotes the dispersion of ink further by finely vibrating meniscuses in the nozzle arrays placed in the non-flushing state (i.e., during the resting period). This operation is referred as a meniscus vibration. In the present embodiment, vibrating pulses of the recording drive signals are used in both of the pre-flushing meniscus vibration and the meniscus vibration.

Also as mentioned above, the controller 14 performs control using the above-mentioned first drive signal COM1 to destroy the meniscuses that have viscous to film-like form and efficiently eject the unnecessary ink near nozzle orifices 40 in the first half of the flushing operation (for example, the first half of the prescribed number of ejections), and performs control using the above-mentioned second drive signal to increase the flushing amount per unit time and eject the unnecessary ink at the inner side (pressure chamber 38 side) of nozzle orifices 40 more definitely in the second half of the flushing operation (for example, the second half of the prescribed number of ejections).

By thus performing, until the ejection of ink droplets of the prescribed flushing number is completed, the flushing operation to control either the odd-number nozzle arrays or the even-number nozzle arrays to be in the flushing state while the other arrays are in the non-flushing state and thereby providing a plurality of resting periods (non-flushing states) for each group, the unnecessary ink can be ejected more efficiently by the ink dispersion actions in the resting periods. Since the unnecessary ink ejection can thus be obtained adequately with a lower flushing number, the time required for the flushing operation can be shortened to speed up the overall operations of the printer 1 and lower the consumption amount of ink during the flushing operation.

Since intermittent flushing is realized by alternately executing the unit flushing operations for the odd-number nozzle arrays and the even number nozzle arrays, simultaneous flushing of mutually adjacent nozzle arrays is avoided. Efficient ejection of unnecessary ink can thus be carried out while restraining the generation of an updraft at regions between adjacent nozzle arrays and thereby preventing the problem of a part of the ejected ink droplets becoming a mist and riding on the updraft and thereby becoming attached to nozzle plate 33 of the recording head 2.

By providing a plurality (125 times for one group of nozzle arrays in the present embodiment) of resting periods intermittently, contributions can be made to improvement of the unnecessary ink ejection while making one resting period (duration of the non-flushing state) as short as possible and yet preventing ink from being viscous.

Figure 7:
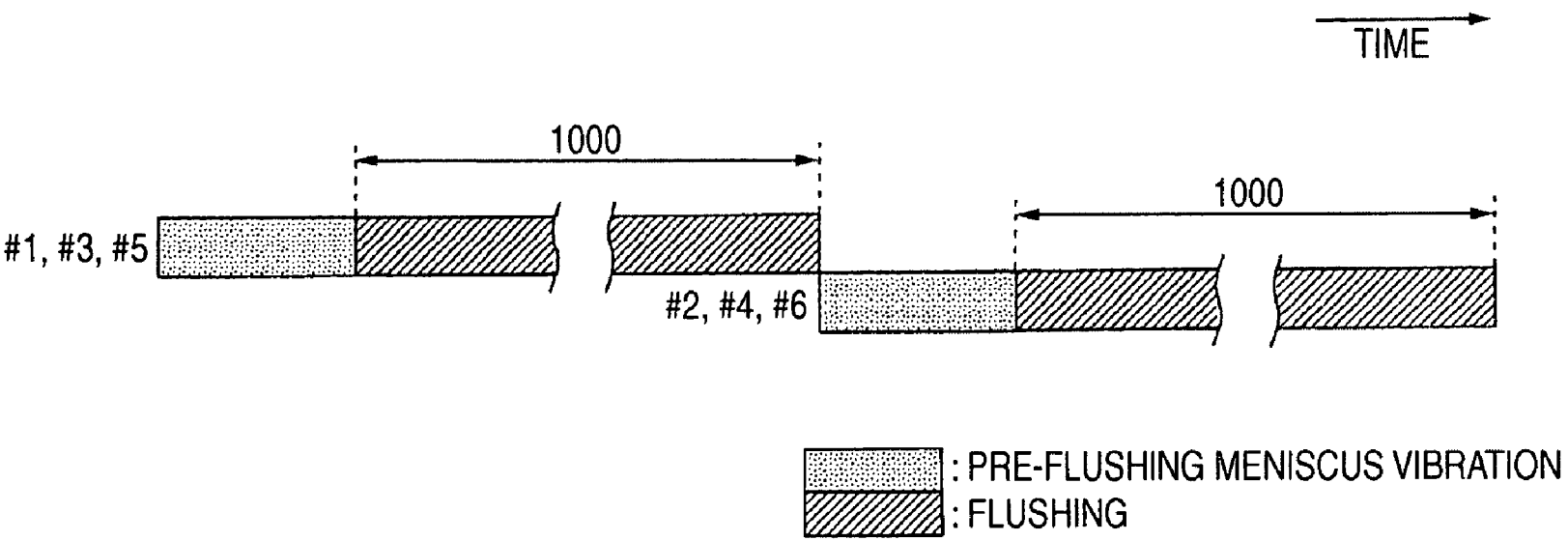
FIG. 7 is a time chart for explaining a flushing operation performed in a related art ink jet printer.

In the configuration shown in FIG. 7, a total of two times of pre-flushing meniscus vibrations are executed, that is, once prior to the flushing operation of the odd-number nozzle arrays and once prior to the flushing operation of the even-number nozzle arrays. However, according to this embodiment, since just one time of pre-flushing meniscus vibration is executed, the total time required for the flushing operation can be shortened.

In the case where the prescribed flushing number is set to a value that is not divisible by the unit flushing number, the number of times of flushing operation for one group is rounded up. That is, for example, if for a unit flushing number of 8, the prescribed flushing number is set to 1500, the prescribed flushing number is not divisible by the unit flushing number since 1500/8=187.5. In this case, the number of times of the flushing operation for one group is rounded up to 188 times. Thus in the switching flushing operation, a total of 376 times of switching is carried out.

Figure 6:
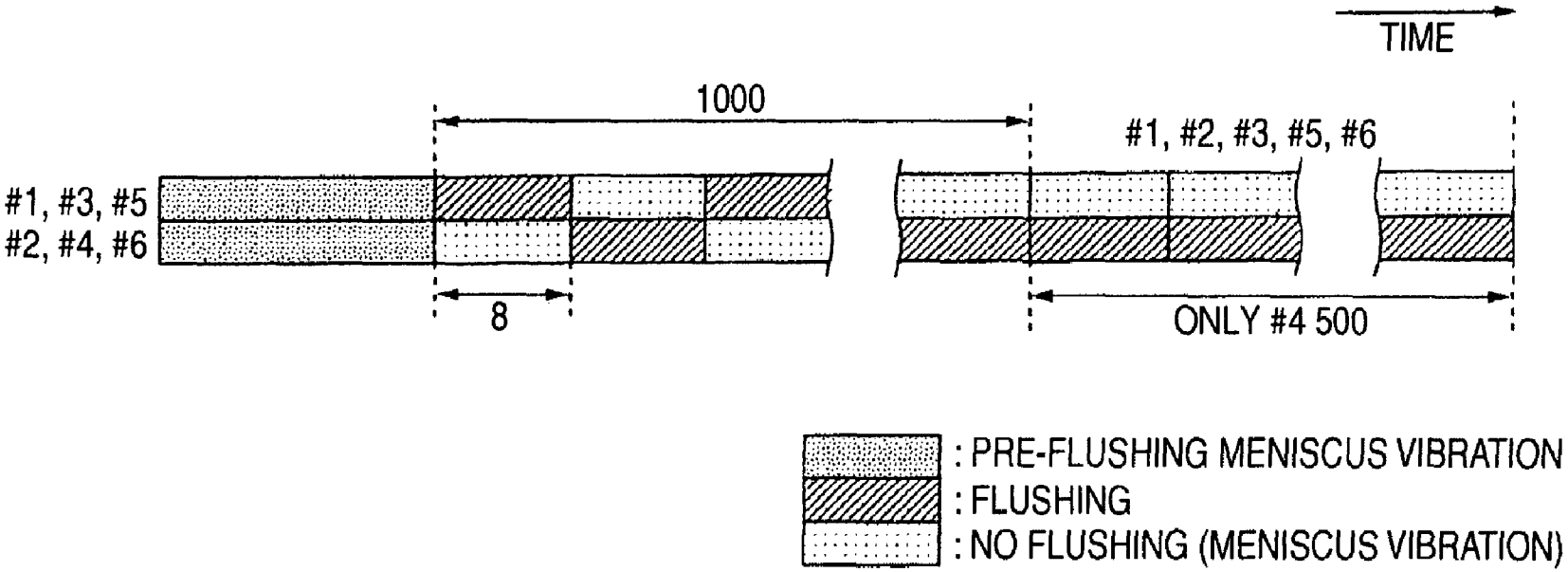
FIG. 6 is a time chart for explaining a flushing operation performed in an ink jet printer according to a second embodiment of the invention.

FIG. 6 is a time chart of the flushing operation according to a second embodiment of the invention. In this embodiment, the prescribed flushing number for a part of the nozzle arrays is differed from that of other nozzle arrays. Specifically, the prescribed flushing number is set to 1000 shots for the first, second, third, fifth, and sixth nozzle arrays and the prescribed flushing number for the fourth nozzle array is set to 1500 shots, which is greater than that for the other nozzle arrays.

In this case, after performing the pre-flushing meniscus vibration on all nozzle arrays, the controller 14 performs the switching flushing operation until the ejection of 1000 shot is completed. Control part 14 then sets the nozzle arrays (first, second, third, fifth, and sixth nozzle arrays), for which the ejection of the prescribed flushing number has been completed by this flushing operation of 1000 shots, to the non-flushing state and continuously performs a flushing operation solitarily on the fourth nozzle array, for which the ejection of the prescribed flushing number has not been completed, until the ejection of 500 shots, which is the difference with respect of the prescribed flushing number for the other nozzles, is completed. Thus the flushing operation, to which this invention is applied, can be performed even in the case where the prescribed flushing number differs according to the nozzle array.

In FIG. 6, the excess 500 shots of the ejections are executed for the fourth nozzle array after the alternate execution of the unit flushing operations. However, it may be performed prior to or in the middle of the alternate execution of the unit flushing operations. The non-flushing state until the start of the recording operation can thereby be made as short as possible for the other nozzle arrays besides the fourth nozzle array to prevent ejection faults due to viscous ink.

This invention is not limited to the above-described embodiments and various modifications based on the description of the claims are possible.

In each of the embodiments described above, the unit flushing number is the same for the odd-number nozzle arrays and the even-number nozzle arrays. However, the unit flushing number may be made different between the odd-number nozzle arrays and the even-number nozzle arrays. For example, in the case where the prescribed flushing number of the odd-number nozzle arrays is 1000 shots and the prescribed flushing number of the even-number nozzle arrays is 1500 shots, the ejection of the prescribed flushing numbers of the two groups can be completed in a total of 250 times of switching flushing operation by setting the unit flushing number of the odd-number nozzle arrays to 8 shots and setting the unit flushing number of the even-number nozzle arrays to 12 shots.

In the above embodiments, the meniscus vibrations are performed during the resting period. However, it may be omitted.

In the above embodiments, two different types of flushing drive signals (the first drive signal COM1 and the second drive signal COM2) are used in the first half and the second half of the flushing operation. However, one type or three or more types of flushing drive signal may be used.

In the above embodiments, the piezoelectric vibrator 29 of the so-called longitudinal vibration mode is used. However, a piezoelectric vibrator deformable in the direction that the electric field is applied may be used. Furthermore, the piezoelectric vibrator of a so-called flexural vibration mode may be used so as to oppose to each pressure chamber 38 in a one-by-one manner. Instead of a piezoelectric vibrator, a heat generating element or other form of pressure generating element may be used.

This invention can also be applied to a liquid ejection apparatus with a liquid ejection head besides the above-described recording head 2. For example, applications to a display manufacturing apparatus, an electrode manufacturing apparatus, a chip manufacturing apparatus, a micropipette, etc., are also possible.

What is claimed is:

1. A liquid ejection apparatus, comprising:

a liquid ejection head, comprising:

pressure chambers, each of which is adapted to store liquid therein;

nozzle orifices, each of which is communicated with one of the pressure chambers, the nozzle orifices being arranged so as to form a first group of nozzle arrays and a second group of nozzle arrays; and pressure generating elements, each of which is operable to generate pressure fluctuations in the liquid stored in one of the pressure chambers to eject a liquid droplet from one of the nozzle orifices associated with the one of the pressure chamber;

a first region, in which a target medium to which the liquid droplet is landed is placed;

a second region, in which no target medium is placed; and a controller, operable to cause the liquid ejection head to flush liquid droplets at the second region such that a first prescribed number of liquid droplets are flushed from each of the nozzle orifices in the nozzle arrays of the first group, and a second prescribed number of liquid droplets are flushed from each of the nozzle orifices in the nozzle arrays of the second group, wherein at least a part of the first prescribed number of liquid droplets and at least a part of the second prescribed number of liquid droplets are flushed by alternately execution a first unit flushing operation for flushing a third prescribed number of liquid droplets which is smaller than the first prescribed number and a second unit flushing operation for flushing a fourth prescribed number of liquid droplets which is smaller than the second prescribed number; and wherein the third prescribed number and the fourth prescribed number are different from each other.

2. The liquid ejection apparatus as set forth in claim 1, wherein:

a meniscus of the liquid in each of the nozzle orifices in the first group of the nozzle arrays is vibrated such an extent that a liquid droplet is not ejected therefrom while the second unit operation is performed; and a meniscus of the liquid in each of the nozzle orifices in the second group of the nozzle arrays is vibrated such an extent that a liquid droplet is not ejected therefrom while the first unit operation is performed.

3. The liquid ejection apparatus as set forth in claim 1, wherein one of the nozzle arrays in the first group and one of the nozzle arrays in the second group are arranged adjacent to each other.

4. The liquid ejection apparatus as set forth in claim 1, wherein the first prescribed number and the second prescribed number are identical with each other.

5. The liquid ejection apparatus as set forth in claim 1, wherein the first prescribed number and the second prescribed number are different from each other.

6. The liquid ejection apparatus as set forth in claim 1, wherein the third prescribed number and the fourth prescribed number are identical with each other.

* * * * *